US009677159B2

(12) United States Patent
Ha et al.

(10) Patent No.: US 9,677,159 B2
(45) Date of Patent: Jun. 13, 2017

(54) METHOD OF MANUFACTURING MARTENSITIC STAINLESS STEEL SHEET USING TWIN ROLL STRIP CASTER

(71) Applicant: POSCO, Pohang-si, Gyeongsangbuk-do (KR)

(72) Inventors: Man-Jin Ha, Pohang-si (KR); Sung-Jin Park, Pohang-si (KR); Byoung-Jun Song, Pohang-si (KR)

(73) Assignee: POSCO, Pohang-si (KR)

( * ) Notice: Subject to any disclaimer, the term of this patent is extended or adjusted under 35 U.S.C. 154(b) by 330 days.

(21) Appl. No.: 14/539,386

(22) Filed: Nov. 12, 2014

(65) Prior Publication Data

US 2015/0129157 A1 May 14, 2015

(30) Foreign Application Priority Data

Nov. 14, 2013 (KR) ..... 10-2013-0138180

(51) Int. Cl.

| | |
|---|---|
| ***C21D 8/02*** | (2006.01) |
| ***C22C 38/18*** | (2006.01) |
| ***C21D 6/00*** | (2006.01) |
| ***B22D 11/00*** | (2006.01) |
| ***B22D 11/12*** | (2006.01) |

(52) U.S. Cl.

CPC ..... *C22C 38/18* (2013.01); *B22D 11/002* (2013.01); *B22D 11/1206* (2013.01); *C21D 6/002* (2013.01); *C21D 8/0215* (2013.01); *C21D 2211/008* (2013.01)

(58) Field of Classification Search

None

See application file for complete search history.

(56) References Cited

U.S. PATENT DOCUMENTS

| | | | | |
|---|---|---|---|---|
| 2010/0096047 | A1 | 4/2010 | Hammer et al. | |
| 2012/0237390 | A1* | 9/2012 | Jeong ..... | B22D 11/0622 420/70 |
| 2012/0321501 | A1 | 12/2012 | Chae et al. | |
| 2013/0122320 | A1 | 5/2013 | Chae et al. | |

FOREIGN PATENT DOCUMENTS

| | | | |
|---|---|---|---|
| CN | 101041879 | A | 9/2007 |
| CN | 102665963 | A | 9/2012 |
| CN | 102665964 | A | 9/2012 |
| CN | 102666902 | A | 9/2012 |
| JP | 2010-508434 | | 3/2010 |
| KR | 10-2011-0071516 | | 6/2011 |
| WO | 01/40526 | A1 | 6/2001 |

OTHER PUBLICATIONS

Machine-English translation of CN101041879 A, Lei, Zhang Zheng et al., Sep. 26, 2007.*

* cited by examiner

*Primary Examiner* — Deborah Yee

(74) *Attorney, Agent, or Firm* — The Webb Law Firm

(57) ABSTRACT

A method of manufacturing a martensitic stainless steel sheet by allowing ingot steel to pass through two casting rolls rotating in opposing directions through a twin roll strip caster is provided. The method includes rolling a steel sheet cast between the casting rolls at a temperature of 1000 to 1200° C. and a draft percentage of 25 to 50% with a first roller, and rolling the steel sheet at a temperature of 800 to 1000° C. and a draft percentage of 5 to 15% with a second roller.

6 Claims, 2 Drawing Sheets

METHOD OF MANUFACTURING MARTENSITIC STAINLESS STEEL SHEET USING TWIN ROLL STRIP CASTER

CROSS-REFERENCE TO RELATED APPLICATION

This application claims the priority and benefit of Korean Patent Application No. 10-2013-0138180 filed on Nov. 14, 2013, with the Korean Intellectual Property Office, the disclosure of which is incorporated herein by reference.

FIELD OF THE INVENTION

The present disclosure relates to a martensitic stainless steel sheet, and more particularly, to a method of manufacturing a martensitic stainless steel sheet using a twin roll strip caster.

BACKGROUND OF THE INVENTION

Martensitic stainless steel sheets have an excellent degree of corrosion resistance, rigidity, and wear resistance, and thus, may be used for manufacturing various types of metallic instruments and industrial instruments, and, in particular, for razor blades, scalpels for medical use, general knives and scissors, and the like.

In general, martensitic stainless steel may be manufactured by producing slabs using ingot steel subjected to a continuous casting process or using ingot steel while reheating and hot rolling the slabs so as to produce hot rolled strips, performing a batch annealing process to anneal the hot rolled strips, and then performing a pickling process in order to remove scale formed thereon during the hot rolling process. In addition, after the pickling process, a cold rolling process of a material or a process for the processing of a produced product may be applied.

In a structure of steel formed after hot rolling, among the manufacturing processes, a martensite phase, a tempered martensite phase, a ferrite phase, a residual austenite phase, and the like are mixed, and after hot rolling annealing, the structure of steel is transformed to ferrite and carbide to be nitrocarburized. Such a nitrocarburized material (a soft material) undergoes a final heat treatment process so as to be transformed into martensitic steel.

On the other hand, in the case that metallic instruments have a higher level of desired quality, a relatively high degree of rigidity is required. Such a degree of rigidity may be achieved through a basic martensitic structure of steel. Such a martensitic structure is a significantly light fine structure generated at the time of rapidly cooling high-temperature austenite, and as the content of carbon soluble in high temperature austenite phases is increased, carbon soluble in martensite is increased, such that the rigidity of martensite may be increased. Accordingly, in order to manufacture martensitic stainless steel having a relatively high degree of rigidity, the content of carbon therein should be able to be increased.

However, as the content of carbon in steel is increased, a degree of segregation becomes severe and high area coexistence is increased so as to be significantly vulnerable to casting. Thus, martensitic stainless steel has mainly been manufactured through an ingot casting method. However, in the case of the ingot casting method, coarse precipitates and central segregation may occur at grain boundaries, due to a slow cooling rate, thereby causing a deterioration of quality in post processing.

Recently, as a method replacing the ingot casting method, a method of manufacturing martensitic stainless steel using a twin roll strip caster has emerged, so that the occurrence of central segregation may be suppressed and the precipitation of chrome carbon may be reduced at an initial grain boundary to improve a level of quality.

However, even in a case in which martensitic stainless steel is cast using such a twin roll strip caster, since fine structures generated while being pressed and coagulated in a casting roll of a strip caster may also remain in finally produced products, uniformity may be degraded.

SUMMARY OF THE INVENTION

Some embodiments in the present disclosure may provide a method of manufacturing a martensitic stainless steel sheet using a twin roll strip caster, through which a fine structure having uniform carbon distribution may be obtained.

According to some embodiments in the present disclosure, a method of manufacturing a martensitic stainless steel sheet by allowing ingot steel to pass through two casting rolls rotating in opposing directions through a twin roll strip caster, may include performing a first rolling process of rolling a steel sheet cast between the casting rolls, with a first roller, to induce recrystallization to occur; and performing a second rolling process of rolling the steel sheet with a second roller to generate carbon precipitation sites.

BRIEF DESCRIPTION OF DRAWINGS

The above and other aspects, features and other advantages of the present disclosure will be more clearly understood from the following detailed description taken in conjunction with the accompanying drawings, in which.

DETAILED DESCRIPTION

Figure 1:
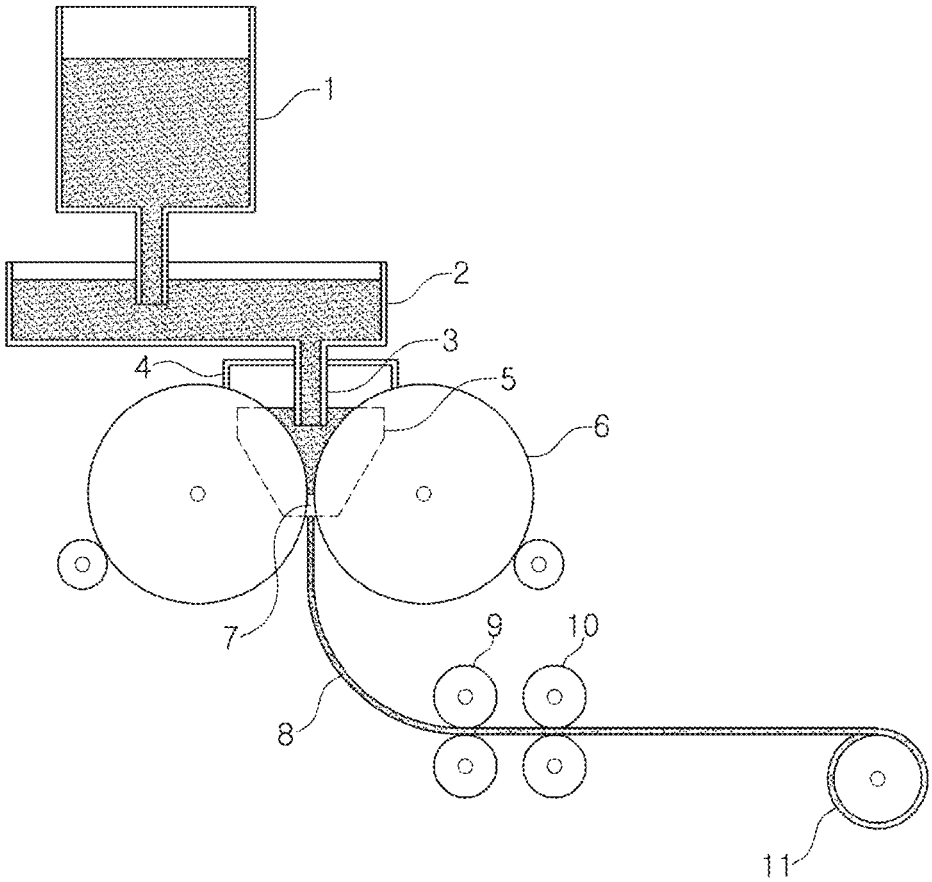
FIG. 1 is a diagram illustrating a twin roll strip casting process in which tandem rolling may be performed, according to an embodiment in the present disclosure.

Embodiments in the present disclosure will now be described in detail with reference to the accompanying drawings.

The disclosure may, however, be exemplified in many different forms and should not be construed as being limited to the specific embodiments set forth herein. Rather, these embodiments are provided so that this disclosure will be thorough and complete, and will fully convey the scope of the disclosure to those skilled in the art.

In the drawings, the shapes and dimensions of elements may be exaggerated for clarity, and the same reference numerals will be used throughout to designate the same or like elements.

According to an embodiment in the present disclosure, a method of manufacturing a martensitic stainless steel sheet having a fine structure, in detail, a structure having uniform carbon distribution, by performing tandem rolling using two hot rollers, in a manner different from a manner in which only one hot roller is used in a twin roll strip casting process according to the related art, may be provided.

FIG. 1 illustrates a twin roll strip casting process in which tandem rolling, according to an embodiment in the present disclosure, is undertaken. Ingot steel, supplied to a gap between a pair of casting rolls 6 rotating in opposing directions, through an injection nozzle 3 attached to a tundish 2, may form a molten pool encompassed by the casting rolls 6 and an edge dam 5 and may form a sheet 8 while contacting surfaces of the casting rolls 6 to be coagulated. The sheet 8 may be rolled by a first roller 9 and subsequently rolled by a second roller 10, and may then be subjected to a process using a batch annealing furnace (BAF) and a process in which the sheet is wound by a coil winding device 11, whereby a martensitic stainless steel sheet according to an embodiment in the present disclosure may be manufactured.

For example, immediately after the sheet 8 is cast by the casting rolls 6, the sheet 8 may be rolled by the first roller 9 to remove internal holes while inducing re-crystallization to occur and may be rolled by the second roller 10 to allow plastic energy of an amount sufficient to generate a large amount of carbon precipitation sites to be accumulated in the inside of crystal grains, such that a finally produced martensitic stainless steel sheet may have uniform carbon distribution.

In a case in which rolling is performed at a high temperature of 1000 degrees or more only using the first roller 9, without the sheet passing through the second roller, recrystallization may occur, such that plastic energy applied to the inside of the sheet 8 may be released through the recrystallization. In the case that rolling is only performed at a relatively high temperature through the first roller 9, recrystallization may occur smoothly to reduce a grain size and thus obtain uniformity. However, since carbon precipitation may subsequently occur in a grain boundary during the BAF process, while a degree of carbon precipitation is relatively low inside crystal grains, non-uniformity may be caused.

On the other hand, after rolling is performed by the first roller 9, when rolling is undertaken by the second roller 10, recrystallization may not occur and plastic energy applied to the inside of the sheet 8 may be accumulated. Subsequently, carbon may be generated inside crystal grains in the BAF process, and a finally produced martensitic stainless steel sheet may have uniform carbon distribution.

Rolling performed by the first roller 9 may be performed under temperature conditions of 1000 to 1200° C. at a draft percentage of 25 to 50%, so as to promote recrystallization, and in the case of carbides, precipitation thereof may first occur at a grain boundary. In the case of a steel sheet in which recrystallization has smoothly occurred to allow relatively small grains to be formed, carbides may be uniformly precipitated as compared to the case of a steel sheet formed without recrystallization to have coarse grains. In the rolling process using the first roller, when rolling is performed at a recrystallization temperature of 1000° C. or higher at a draft percentage of 25% or more, recrystallization may occur effectively. On the other hand, in order to secure a temperature of 1200° C. or higher in the process using the first roller, a reheating device is required, but in this case, additional equipment is uneconomical. In addition, in order to perform rolling at a draft percentage of 50% or more, since a large scale roller is required, it may be difficult to attain such a large-sized roller. Further, even in a case in which recrystallization occurs effectively in the process using the first roller 9, it may be difficult to obtain uniform carbides, and thus, rolling may be further required in the process using the second roller 10.

In the process using the second roller, rolling may be performed at a temperature of 800 to 1000° C. at a draft percentage of 5 to 15%, such that plastic strain energy of an amount sufficient to generate carbon precipitation sites may be accumulated in the inside of crystal grains. Since the process using the second roller 10 is performed subsequently to rolling performed using the first roller 9, a temperature of a steel sheet may be lower than 1000° C., and further, since a temperature of the steel sheet is relatively low and a relatively high draft percentage for rolling is required, it may be difficult to reach a draft percentage of 15% or more. In addition, in the process using the second roller, in a case in which a temperature of the steel sheet is 800° C. or lower, the draft percentage is extremely high, and thus, rolling of 5% or more may be difficult to be performed.

For example, in a case in which rolling is performed at a temperature of 800 to 1000° C. using a single roller without performing tandem rolling, in a manner different from that of the present disclosure in which the tandem rolling is undertaken, it may be difficult to obtain (a degree of) rolling of 20% or more. This is why the temperature is relatively low and a draft percentage is thus significantly high. Meanwhile, in a case in which a total of draft percentages do not reach a range of 25 to 50%, since recrystallization may not occur and pores generated at the time of performing internal casting may not be removed, a material may be so brittle that post processing may not be performed and quality may be deteriorated.

In detail, a composition of a martensitic stainless steel sheet according to an embodiment in the present disclosure may include 0.5 to 0.8 weight % of carbon (C) and 12.5 to 14.5 weight % of chromium (Cr). Such a component composition may be a composition required when a high quality of razor blade is produced. By manufacturing a martensitic stainless steel sheet according to an embodiment in the present disclosure, uniform carbide distribution required in producing a high quality of razor blades may be exhibited. Therefore, such a compositional range according to an embodiment in the present disclosure may be applied.

The sheet 8 cast by the casting rolls 6 may have a thickness of 3 to 4 mm and the sheet 8 may be rolled to have a thickness of 2.2 to 2.5 mm in the rolling process using the first roller 9 and a thickness 1.8 to 2 mm in the rolling process using the second roller 10. For example, when a razor blade is produced using the finally produced rolled steel sheet, a thickness of the razor blade may be 0.075 to 0.15 mm, and thus, a large amount of cold rolling should be performed. In addition, an annealing heat treatment needs to be performed during the cold rolling, and as a rolling thickness is reduced, amounts of required post processing cold rolling passes and cold rolling annealing heat treatments are reduced, whereby productivity may be increased. Thus, final rolling may be performed to allow for a relatively thin rolled thickness of 2 mm or less. On the other hand, in a case in which a rolled thickness is equal to a thickness of 1.8 mm or less, there is a possibility that breakage may occur in the rolled sheet during hot rolling batch annealing, edge trimming and pickling processes. Since a hot rolling batch-annealed material may be provided as martensite, significantly vulnerable to impacts, in a case in which a thickness is relatively thin, a possibility that breakages may occur in a rolled sheet due to impacts may be present. In an actual production line, when the material is rolled as a sheet, breakages may not occur in a sheet forming process of a material having a thickness of 1.8 mm or more, while a large amount of breakages may occur in the case of a thinner material in the sheet forming process. Thus, a rolling material may have a thickness of 1.8 mm to 2 mm or less, such that productivity may be improved through a reduction in a possibility of the occurrence of breakage in a rolled sheet in required post-processing and reduction in final cold rolling pass and annealing heat treatment numbers. In addition, in order to allow a finally obtained rolled thickness to be confined to a range of 1.8 to 2 mm, a cast sheet should have a thickness of 3 to 4 mm so as to satisfy a draft percentage of 25 to 50% in the process using the first roller and a drat percentage of 5 to 15% in the process using the second roller. Further, the sheet may have a thickness of 2.2 to 2.5 mm in the process using the first roller.

In a case in which rolling is performed using a single hot roller as in the related art, a sheet is generally cast at a thickness of 3 mm, and rolling is then performed to have a thickness of 2 mm in a process using a subsequently provided roller. In a case in which a martensitic stainless steel sheet is manufactured through a process such as that according to the related art, a degree of recrystallization by hot rolling may be limited, causing non-uniform carbide distribution in a finally produced product.

The present disclosure will be described below in further detail.

Embodiment

In an embodiment of the present disclosure, molten metal containing 0.7 weight % of carbon (C), 13 weight % of chromium (Cr), 0.3 weight % of silicon (Si), 0.7 weight % of manganese (Mn), 0.02 weight % of phosphorus (P), 0.002 weight % of sulfur (S), 0.2 weight % of nickel, and 0.03 weight % of nitrogen (N), as well as inevitable impurities and ferrum (Fe) as a remainder, was cast as sheets having thicknesses illustrated in the following table using a twin roll strip caster of FIG. 1 and then rolled under the conditions as illustrated in the following table.

Figure 2:
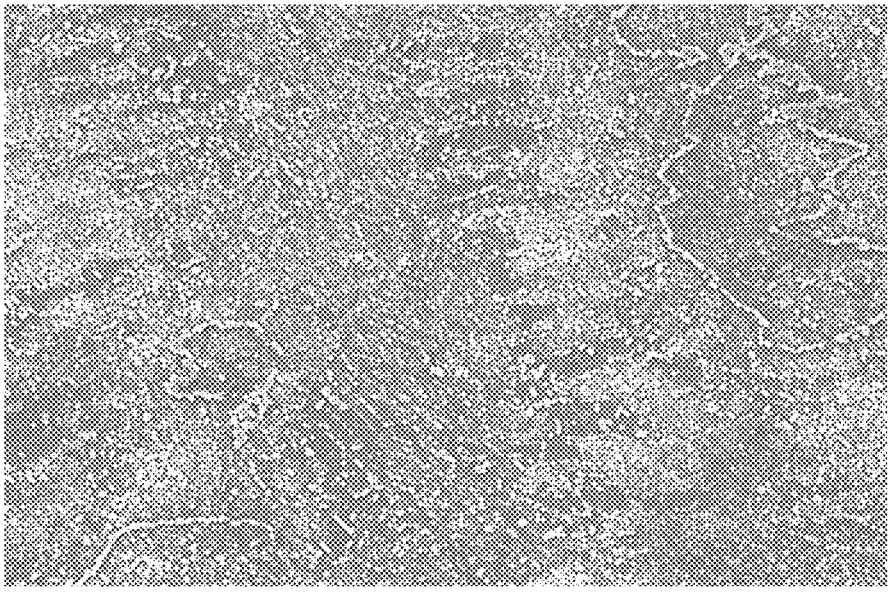
FIG. 2 is a scanning electron microscope (SEM) photograph illustrating carbon distribution in a martensitic stainless steel sheet manufactured using a twin roll strip caster according to the related art.
Figure 3:
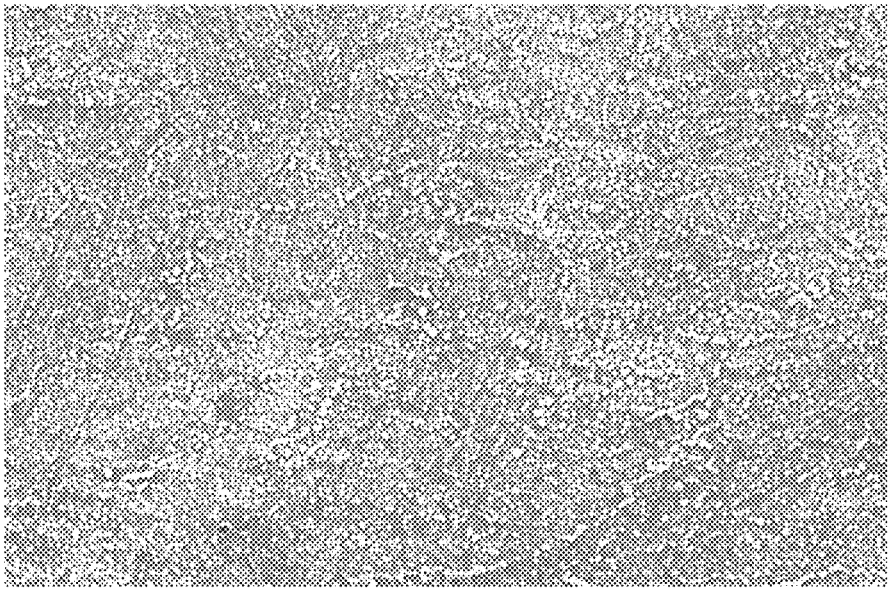
FIG. 3 is a SEM photograph illustrating carbon distribution in a martensitic stainless steel sheet manufactured by performing tandem rolling according to an embodiment in the present disclosure.

Uniformity of carbon distribution of cross sections of the rolled sheets (in 1000× magnification SEM photographs) was determined, and results thereof are illustrated in the following table. Further, with respect to Comparative Example 1 and Embodiment 3 of the present disclosure, SEM photographs were provided in order to determine carbon distribution uniformity, and a result from Comparative Example 1 is illustrated in FIG. 2 and a result from Embodiment 3 is illustrated in FIG. 3. In FIG. 2, a size of a region in which carbide is not present is an effective diameter of around 10 10 um. In addition, it can be appreciated from FIG. 3 that a size of a region in which carbide is not present is within an effective diameter of 2 um. In this case, the observation of carbide was carried out, based on a 1000× magnification SEM photograph. In the following table, in the case of the structures of cross sections of rolled steel sheets in 1000× magnification SEM photographs, when an effective diameter of the region in which carbide is not present was 5 um or more, the carbon distribution was determined as being non-uniformity, and when an effective diameter of the region in which carbide is not present was within Sum, the carbon distribution was determined as being uniform.

A sheet of Comparative Example 1 of the following table was only manufactured using a twin roll strip caster and a first roller according to the related art, and sheets of Embodiments 1 to 3 were manufactured according to the present disclosure.

In addition, in Embodiments 1 to 3 of the present disclosure, a product having a thickness of 2.0 mm was produced by allowing a casting thickness to be gradually increased. A draft percentage of the first roller was increased within a range of 28 to 39%, and a draft percentage of a second roller was increased within a range of 7.4 to 11.5%.

TABLE

| | | | First Roller | | Second Roller | | Uniformity |
|---|---|---|---|---|---|---|---|
| | Casting Thickness | Product Thickness | Rolling Temperature | Draft Percentage | Rolling Temperature | Draft Percentage | in Carbon Distribution |
| Comparative Example 1 | 3.0 | 2.0 | 1150 | 33 | | | Non-uniform |
| Embodiment 1 | 3.0 | 2.0 | 1150 | 28 | 950 | 7.4 | Uniform |
| Embodiment 2 | 3.5 | 2.0 | 1100 | 35 | 900 | 11.5 | Uniform |
| Embodiment 3 | 3.7 | 2.0 | 1080 | 39 | 850 | 11.5 | Uniform |

As illustrated in the Table above, it can be appreciated that uniform carbon distribution is exhibited in sheets manufactured in Embodiments 1 to 3 of the present disclosure. As illustrated in FIG. 3, a SEM photograph illustrating carbide distribution in Embodiment 3 of the present disclosure, carbon distribution is significantly uniform and there are few or no locations in which carbon is not present. Such a carbon distribution may be determined as being significantly good.

On the contrary, in the case of Comparative Example 1 in which the sheet was only manufactured using the twin roll strip caster and the first roller according to the related art, it can be appreciated that carbon distribution was not uniform. As illustrated in FIG. 2, a SEM photograph illustrating carbide distribution in Comparative Example 1, it can be observed that carbon is continuously precipitated in a grain boundary and there are many vacant portions in which carbon is not precipitated within crystal grains.

As in Comparative Example 1, in the case that a sheet cast by casting rolls of the twin roll strip caster is hot rolled using a single roller, is subjected to a batch annealing furnace (BAF) process and is then manufactured as a martensitic stainless steel sheet, carbides are precipitated in a re-crystallized grain boundary during the BAF process after hot rolling, and carbides may not be precipitated inside crystal grains. As a result, carbon distribution may not be uniform.

A martensitic stainless steel sheet having uniform carbon distribution may be obtained through a method of manufacturing a martensitic stainless steel sheet using a twin roll strip caster according to an embodiment in the present disclosure. In a case in which carbon distribution of the steel sheet is not uniform, a difference in an amount of carbon contained in a matrix between a region in which an amount of carbide is relatively small and a region in which a relatively great amount of carbide is present may be caused so that non-uniformity in terms of a quality thereof such as rigidity and the like may occur. Such a non-uniform quality may also cause non-uniform stress to occur during heat treatment of a steel sheet, allowing the steel sheet to be transformed and allowing for the occurrence of defective products, for example, defects in a product shape. However, according to a manufacturing method of the present disclosure, a martensitic stainless steel sheet having uniform carbon distribution may be obtained, thereby preventing the occurrence of a non-uniform quality and a defective product in a shape thereof, and the like.

While embodiments have been shown and described above, it will be apparent to those skilled in the art that modifications and variations could be made without departing from the scope of the present disclosure as defined by the appended claims.

What is claimed is:

1. A method of manufacturing a martensitic stainless steel sheet by allowing ingot steel to pass through two casting rolls rotating in opposing directions through a twin roll strip caster, wherein a composition of the ingot steel comprises 0.5 to 0.8 weight % of carbon (C) and 12.5 to 14.5 weight % of chromium (Cr), the method comprising:

performing a first rolling process of rolling a steel sheet cast between the casting rolls, with a first roller, to induce recrystallization to occur; and performing a second rolling process of rolling the steel sheet having been subjected to the first rolling process, with a second roller, to generate carbon precipitation sites.

2. The method of claim 1, wherein the first rolling process is performed at a temperature of 1000 to 1200° C. at a draft percentage of 25 to 50%.

3. The method of claim 1, wherein the second rolling process is performed at a temperature of 800 to 1000° C. at a draft percentage of 5 to 15%.

4. The method of claim 1, wherein the steel sheet is cast between the casting rolls to have a thickness of 3 to 4 mm.

5. The method of claim 1, wherein the steel sheet is rolled by the first roller to have a thickness of 2.2 to 2.5 mm.

6. The method of claim 1, wherein the steel sheet rolled through the first rolling process is rolled by the second roller to have a thickness of 1.8 to 2 mm.

* * * * *